US005529131A

United States Patent [19]

Van Ornum

[11] Patent Number: 5,529,131

[45] Date of Patent: Jun. 25, 1996

[54] GRADING ATTACHMENT

[76] Inventor: Leslie G. Van Ornum, P.O. Box 446, Hortonville, Wis. 54944

[21] Appl. No.: 535,565

[22] Filed: Sep. 28, 1995

[51] Int. Cl.[6] ..... E02F 3/76

[52] U.S. Cl. ..... 172/789; 172/791; 172/796; 172/797; 172/776

[58] Field of Search ..... 172/776, 781, 172/780, 789, 788, 791, 792, 793, 795, 796, 797, 799.5

[56] References Cited

U.S. PATENT DOCUMENTS

| | | | |
|---|---|---|---|
| 3,164,915 | 1/1965 | Benner et al. | 172/797 |
| 3,450,213 | 6/1969 | Creighton et al. | 172/781 X |
| 3,739,861 | 6/1973 | Johnson et al. | 172/793 |
| 3,763,938 | 10/1973 | Broderson | 172/789 |
| 3,763,987 | 6/1973 | Easterling | 172/781 X |
| 3,791,457 | 2/1974 | Hanser et al. | 172/781 |
| 4,132,290 | 1/1979 | Dezelan et al. | 172/789 X |
| 4,175,625 | 11/1979 | Puckett | 172/791 |
| 4,236,587 | 12/1980 | Shader et al. | 172/780 X |

OTHER PUBLICATIONS

Bobcat Grader (Catalog sheet) Melroe Company Fargo, North Dakota.

*Primary Examiner*—Randolph A. Reese
*Assistant Examiner*—Christopher J. Novosad
*Attorney, Agent, or Firm*—Russell L. Johnson

[57] ABSTRACT

A grading attachment for loader type utility vehicles is provided. The attachment secures to the front of the loader and has an overarching beam which ends in a set of ground engaging wheels. A drawbar is secured to the front of the beam at a ball and socket joint and movably retained at the back of the beam by a vertical channel so that the drawbar can be readily exchanged for another similar drawbar. The drawbar has a sleeve into which a mounting pin may be secured so as to permit the attaching and detaching of a grading implement.

6 Claims, 2 Drawing Sheets

FIG. 2
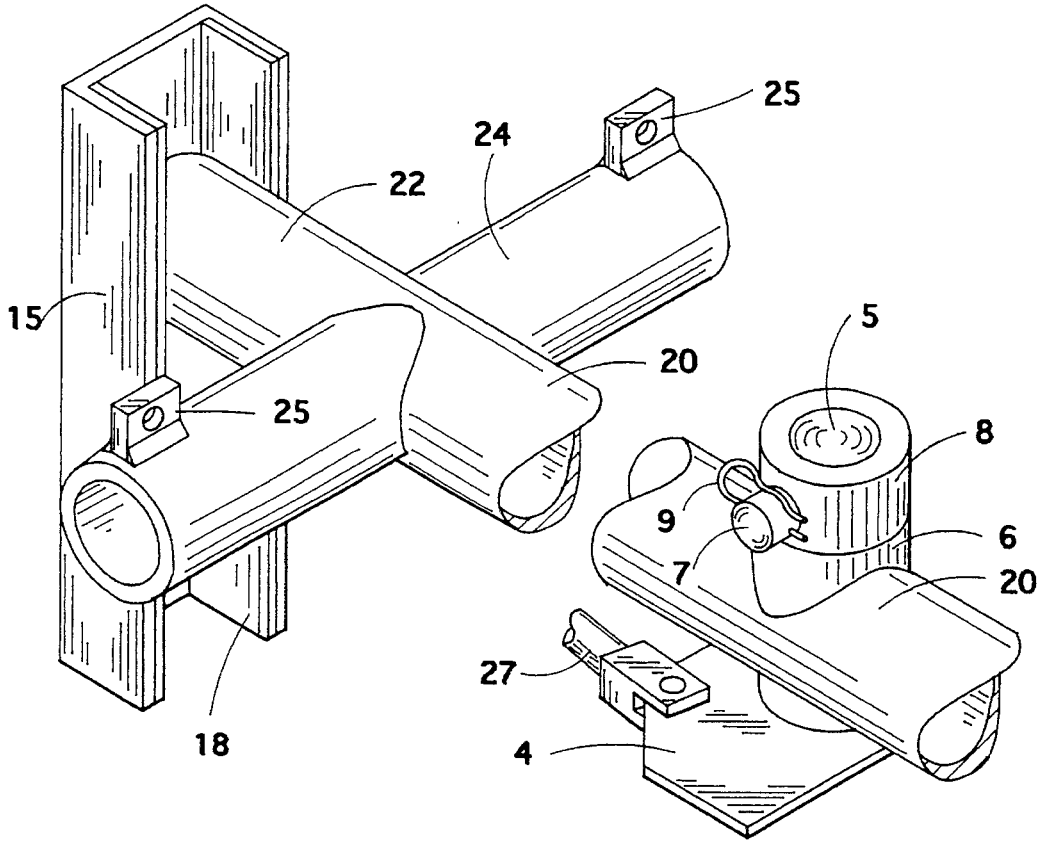
FIG. 3
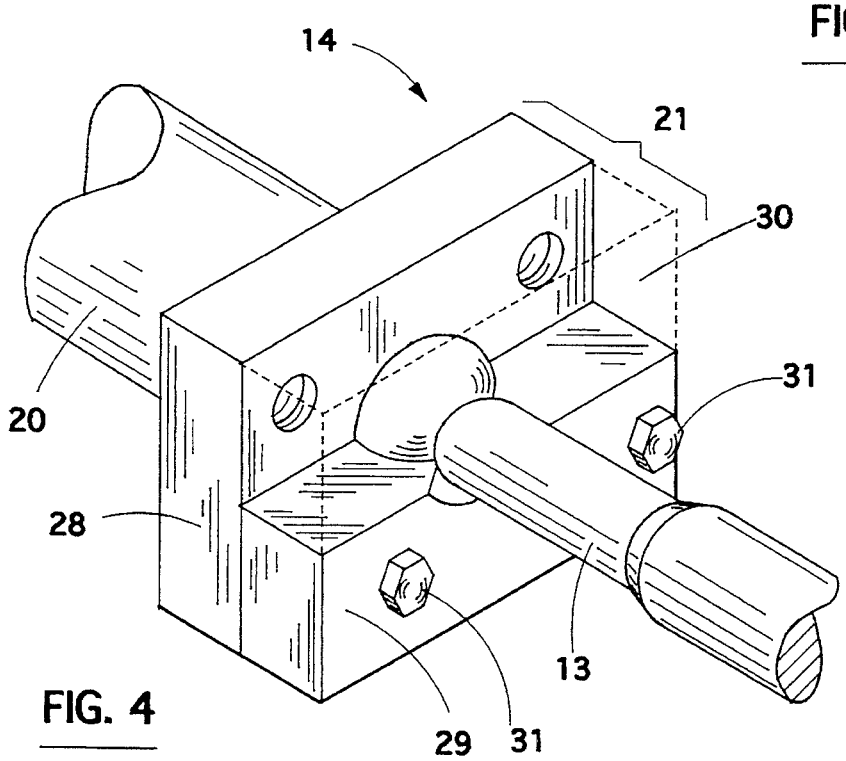
FIG. 4

GRADING ATTACHMENT

FIELD

This invention relates to earth grading and maintenance attachments.

More specifically, this invention relates to earth grading and maintenance attachments for loader type utility vehicles.

BACKGROUND

Grader type earth moving and maintenance machines can be described as; a back power unit and a front arch unit which ends in a set of wheels and a grader blade suspended from the arch. Most graders are dedicated machines used almost exclusively for grading. However, it has long been possible to combine a front arch and a grader blade with a power unit which is also used for operations other than grading.

One such combination which is used is to combine the power unit of what is commonly called a skid loader or a front loader (loader) with a grader arch that replaces the bucket or skid unit of the loader. The ability to convert a loader to a grader is of value to landscapers, large industrial firms, parks, municipalities and the like where the cost of a dedicated grader unit is not warranted.

One deficiency seen in such combinations is that the grader attachment is a unit that can not readily be converted to use other implements such as v-plows, brushes, drags, subsoilers, trenchers, and other implements that would be of utility to landscapers and grounds maintenance personnel.

OBJECTS

It is, therefore, an object of this invention to provide an attachment for loaders and other similar units wherein the attachment is readily secured to and detached from the unit.

It is further an object of this invention to provide the attachment as described above wherein the attachment is of simple, durable and versatile construction.

It is further an object of this invention to provide the attachment as described above wherein portions of the attachment may be replaced with other similar portions so as to permit the attachment to employ a multiplicity of implements.

It is further an object of this invention to provide the attachment described above wherein a novel combination of construction elements renders the attachment able to accomplish the modes of movement required for use of the implements that are attached thereto.

Other objects will be made apparent by the following specifications, drawings, and claims.

PRIOR ART

The prior art is replete wth graders and grader attachments for general utility vehicles such as tractors and loaders.

The prior art is replete with arrangements of mechanisms for establishing and adjusting the positioning of grading tools associated with grading attachments.

The following U.S. patents are representative of the prior art that has elements similar to the elements of the instant invention or that provide the same utilities as the instant invention but do so by means that are different from the means disclosed herein.

U.S. Pat. No. 3,791,457 to Hanser et al teaches a draft frame carrying a grading implement and the draft frame is joined to an overarching main frame by means of a ball joint which permits the draft frame the freedom to rotate about a horizontal axis through 360 degrees and to assume an angle to the horizontal axis of more than 30 degrees.

U.S. Pat. No. 4,175,625 to Puckett teaches an articulated grader frame having a driver section and a chassis frame and means for employing adjustment pistons for the purpose of moving and positioning the mold board of the grader.

U.S. Pat. No. 4,236,587 to Shader et al teaches a land leveling device that is in the form of an overarching frame attachment to a general utility vehicle (tractor).

The Melroe Co. of Fargo North Dakota provides a grader attachment for their Bobcat (TM) loaders. The attachment is provided with a means for securing an overarching frame to the bucket mounts of the loader. The frame is terminated at its distal end by a wheel assembly. A draw bar with a grader moldboard secured thereto is pivotably secured to the frame at the distal end thereof.

The prior art provides some form of some of the elements of construction of the instant invention. The prior art does not provide the combination of elements that make up this invention. Further, a novel draw bar retainer and guide which is a part of this invention is not found in the prior art. Further this invention provides a means for rapidly attaching and detaching a draw bar assembly from the attachment. Still further, the drawbar of this invention is provided with a means for rapidly attaching and detaching an implement to and from the drawbar.

BRIEF DESCRIPTION OF THE DRAWINGS

FIG. 2 is a pictorial view of the proximal end of the drawbar of this invention as it relates to the guide channel of the invention.

FIG. 3 is a pictorial view of a central portion of the drawbar showing the pin mount of this invention.

FIG. 4 is a pictorial view of the distal end of the drawbar showing the ball joint assembly of this invention.

DETAILED DESCRIPTION

Figure 1:
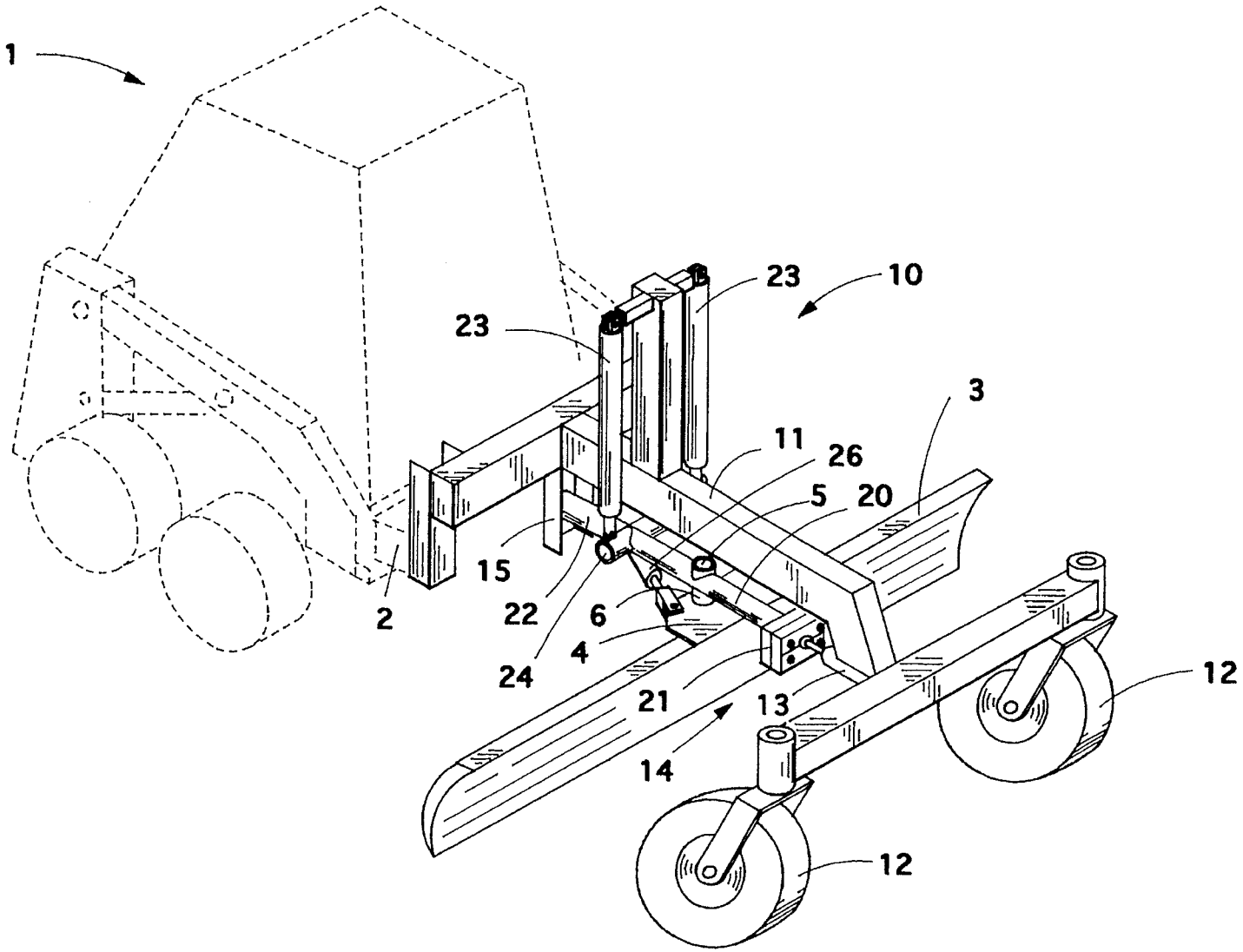
FIG. 1 is a pictorial view of the attachment of this invention.

In the figures, like numbers refer to like objects, the proportions of some elements of the invention have been changed to facilitate illustration. The structures of the invention have been simplified so as to better represent the inventive elements of the invention while omitting elements not essential to disclosing and/or understanding the invention.

In particular, operability of the implements associated with this invention often require the provision of one or more utilities such as hydraulic power, electricity, and less often utilities such as compressed air, a water supply and/or the like. The attachments of this invention are configured so as to make use of releasable couplings to link utilities needed to effectively employ the implement carried by the attachment to sources of these utilities carried on or provided by the utility vehicle. Terms such as up and down, proximal and distal, and the like shall be given their meaning relative to a horizontal plane and the longitudinal axis of the attachment when the attachment is secured to a utility vehicle resting upon the horizontal plane.

The term "a part of" as used relative to structural elements shall be read to include elements that are formed in the indicated component and elements that are permanently joined to the indicated component by means such as welding and the like.

Referring now to FIGS. 1 through 4 wherein the elements that make up this invention are illustrated in simplified form.

A utility vehicle 1, shown dashed in FIG. 1, as a front loader, has secured to its bucket mount 2, a landscaping attachment 10. Attachment 10 has an overarching beam member 11 joined at its proximal end to the bucket mount 2 of utility vehicle 1 and beam 11 is provided at its distal end with earth engaging wheels 12. Beam 11 has secured to its distal end ball member 13 of ball and socket coupling 14 wherein the axis of ball member 13 is horizontal and parallel to the longitudinal axis of attachment 10. Beam member 11 has secured at its proximal end, vertical guide channel 15.

Drawbar 20 is provided at its distal end with socket member 21 of ball and socket coupling 14 as shown in FIGS. 1 and 4. Drawbar 20 is provided at its proximal end with a cylindrical end portion 22 which resides in guide channel 15 so as to permit rotational movement and vertical movement of end portion 22 within guide channel 15.

Drawbar 20 provides a detachable mount for securing landscaping implements to attachment 10. In FIGS. 1 and 3 a mold board 3 is shown attached to a mounting plate 4. Mounting plate 4 is shown to have as a part thereof, mounting pin 5 which passes through mounting sleeve 6 which is a part of drawbar 20. Pin 5 is then secured in place in sleeve 6 by means of securement pin 7 passing through collar 8 and held in place by retainer clip 9.

The above disclosure along with FIGS. 1 through 4 embody the concepts that underlie this invention. However, the utility and versatility of the concepts can be better understood in relationship to a specific configuration and the improvements it provides over prior art attachments intended for similar use.

Overarching beam 11 is detachably secured to the bucket mount 2 of a loader type utility vehicle 1. This enables the use of the raising mechanism and the tilt mechanism of the loader arms of vehicle 1 to be used to raise and lower the entire attachment 10 and to adjust the pitch of a grader blade mounted on attachment 10.

Drawbar 20 is secured to the distal end of beam 11 by means of a ball and socket coupling 14 which enables implements attached to the drawbar to be pulled by the drawbar as opposed to being pushed by the utility vehicle. Ball member 13 has its axis approximately horizontal which enables drawbar 20 to rotate 360 degrees on its longitudinal axis and to tilt at least 30 degrees above and below the horizontal. It should be noted that the two members of coupling 14 could be reversed so that the ball member is carried on drawbar 20 without disturbing the functions of the coupling.

Guide channel 15 is secured to the proximal end of beam 11 to serve as a vertical guide to drawbar 20. Drawbar 20 is provided with a cylindrical proximal end portion 22 which resides in channel 15 and is permitted to rotate freely in channel 15 and is free to move vertically in channel 15. Drawbar 20 is thereby rendered readily exchangeable with a second drawbar of the same length and having the same proximal and distal end configurations.

Landscaping implements such as those contemplated for use with attachment 10 often produce a side thrust when being moved through or over the ground. The absorbtion and counteracting of that side thrust is a problem that complicates the construction of most prior art attachments of the type contemplated by this invention. Channel 15 controls and counteracts side thrusts transmitted through drawbar 20 while permitting the free rotation and vertical movement of drawbar 20.

Ball and socket coupling 14 combines with the free nature of the engagement between cylindrical end portion 22 and channel 15 to permit the rapid exchange of a first drawbar 20 carrying a landscaping implement for a second drawbar 20 carrying a replacement landscaping implement.

It is seen that for operations such as grading, it is sometimes desirable to replace one grading implement with another grading implement. As an example, in clearing snow from a parking lot, it might be desirable to first employ a v-plow to clear a traffic lane, and follow with a mold board to windrow the snow for removal. To facilitate such implement changes, drawbar 20 is provided with a mounting sleeve 6 for receiving a mounting pin 5 which is a part of the implement to be mounted to drawbar 20. Pin 5 and sleeve 6 have an axis that is perpendicular to the axis of drawbar 20.

The ability to quickly change drawbars or alternatively, to change implements mounted to a drawbar gives attachment 10 a versatility not provided by prior art landscaping attachments.

Because the effects of sidethrust on drawbar 20 is limited by channel 15, it becomes possible for attachment 10 to provide a means for raising and lowering the proximal end of drawbar 20 and to rotate drawbar 20 by means of two coacting hydraulic cylinders 23 as shown in FIG. 1. The art provides hydraulic controls that enable two cylinders to act in unison, and/or to cause one cylinder to extend while the other cylinder retracts. Prior art graders often employ two coacting cylinders toadjust positioning and/or rotation of a drawbar but often the cylinders are set at an angle to the vertical so that the cylinders can serve to restrain side thrusts developed by implements attached to the drawbar. The provision in this invention, of channel 15 to restrain movement of drawbar 2D in response to sidethrust permits the positioning of cylinders 23 in a near vertical attitude, thereby reducing their obstruction of the forward vision of the operator while maintaining cylinders 23 in alignment with the direction in which their forces are most effectively applied.

As shown in FIGS. 1 and 2, drawbar 20 is provided with a cross member 24 which is provided with tabs 25 which are connectable with cylinders 23 by clevis and pin connections that are common in the hydraulic cylinder art.

When attachment 10 is employed for grading and similar landscaping work, it is often desirable to change the angle of attack of the implement as it relates to the direction of travel of the drawbar, The engagement of mounting pin 5 which is a part of mounting plate 4 in mounting sleeve 6 as shown in FIGS. 1 and 3 has been discussed above. When a mounting plate 4 carries a grading implement such as mold board 3 as shown in FIG. 1, an adjustment means such as a hydraulic piston 26 having a drive rod 27 can be secured between drawbar 20 and mounting plate 4, as shown in FIGS. 1 and 4 to serve as an attack angle adjusting means.

The best mode of practicing the invention known to the inventor at the time of filing of this disclosure, includes the provision of a channel liner 18 of high density plastic, such as ultra high molecular weight polyethylene (UHMWPE) to serve as high lubricity wear surface for end portion 22 of drawbar 20 to bear against.

As shown in FIG. 4, the best mode of practicing this invention includes a Socket member 21 of ball and socket coupling 14 wherein, the socket member is formed by combining, a drawbar plate 28 which is a part of drawbar 20, a bottom socket plate 29 secured to drawbar plate 28 by means of fasteners 31 and atop socket plate 30, the outline of which is shown dashed in FIG. 4, which is secured to drawbar plate 28 by fasteners 31 in a manner similar to that illustrated in relation to bottom socket plate 29.

The above disclosure is enabling to one skilled in the art and the best mode of practicing the invention at the time of the preparation of this application has been disclosed. However, the invention admits of many variants, the recitation of which would greatly multiply the drawings and cause the specifications to become prolix. Therefore, it should be understood that the scope of the invention should not be limited to the embodiments disclosed, but that the scope of the invention should be limited only by the appended claims and all equivalent thereto that would become apparent to one skilled in the art.

What is claimed is;

1. An attachment for loader type utility vehicles comprising:

a) an overarching beam having a proximal end and a distal end wherein the proximal end is detachably secureable to a bucket mount of a utility vehicle, and the distal end is provided with at least one earth engaging wheel.

b) a first member of a ball and socket joint secured to the distal end of the overarching beam, c) a vertical channel secured to the proximal end of the overarching beam, d) a drawbar having a proximal end and a distal end and the distal end of the drawbar is provided with a second member of a ball and socket coupling and the proximal end of the drawbar is provided with a cylindrical proximal end segment and the distal end of the drawbar is attached to the distal end of the overarching beam by means of a ball and socket formed of said first and second members of a ball and socket joint and the proximal end segment of the drawbar resides inside said vertical channel so that the drawbar is free to rotate about its longitudinal axis and the proximal end of the drawbar is free to move vertically in said vertical channel, and e) a landscaping implement attached to said drawbar.

2. The attachment of claim 1 wherein said first member of said ball and socket joint is a ball member having a horizontal axis.

3. The attachment of claim 1 wherein said second member of said ball and socket joint is a socket member assembly having a drawbar plate which is a part of said drawbar and at least two socket plates which are detachably secureable to said drawbar plate to form said socket member assembly.

4. The attachment of claim 1 wherein said channel member is provided with at least one channel liner of a high lubricity wear resistant plastic material.

5. The attachment of claim 1 wherein said drawbar has as a part thereof, a cross member located near said proximal end and said cross member is provided with attachment means for securing adjustment means for raising and lowering and for rotating said drawbar about its longitudinal axis.

6. The attachment of claim 1 wherein said drawbar has as a part thereof, a mounting sleeve which defines a bore through which a mounting pin may pass and be rotatably secured therein.

* * * * *